United States Patent [19]

Morey et al.

[11] 4,137,156

[45] Jan. 30, 1979

[54] SEPARATION OF NON-MAGNETIC CONDUCTIVE METALS

[75] Inventors: Booker W. Morey, Pasadena; Samuel Rudy, Pomona, both of Calif.

[73] Assignee: Occidental Petroleum Corporation, Los Angeles, Calif.

[21] Appl. No.: 649,784

[22] Filed: Jan. 16, 1976

Related U.S. Application Data

[63] Continuation of Ser. No. 560,972, Mar. 21, 1975, abandoned, which is a continuation of Ser. No. 449,823, Mar. 11, 1974, abandoned.

[51] Int. Cl.[2] ..... B03C 1/16

[52] U.S. Cl. ..... 209/212; 209/227

[58] Field of Search ..... 209/212-215, 209/227, 223 R, 111.8

[56] References Cited

U.S. PATENT DOCUMENTS

| | | | |
|---|---|---|---|
| 1,546,731 | 12/1925 | Weatherby | 209/214 |
| 1,729,589 | 9/1929 | Mordey | 209/214 |
| 3,045,821 | 7/1962 | Cavanagh | 209/227 X |
| 3,294,237 | 12/1966 | Weston | 209/223 X |
| 3,448,857 | 6/1969 | Benson | 209/212 |
| 3,632,229 | 1/1972 | Von Starck | 417/50 |
| 3,824,516 | 7/1974 | Benovitz | 209/212 X |

FOREIGN PATENT DOCUMENTS

| | | | |
|---|---|---|---|
| 2059166 | 6/1972 | Fed. Rep. of Germany | 209/223 R |
| 1347498 | 11/1963 | France | 209/111.8 |
| 305102 | 12/1929 | United Kingdom | 209/212 |

OTHER PUBLICATIONS

Vanderbilt Univ., Annual Report, 1971, Mag. Sep'n of Non-Ferrous Metals, pp. 8-10.

*Primary Examiner*—Robert Halper

*Attorney, Agent, or Firm*—Harris, Kern, Wallen & Tinsley

[57] ABSTRACT

Non-magnetic, conductive metals can be separated from mixtures containing such metals, organic materials and non-metallic inorganic materials by moving a stream of the mixture through a linear motor force field wherein the force field displaces the non-magnetic conductive metals from the stream.

8 Claims, 9 Drawing Figures

SEPARATION OF NON-MAGNETIC CONDUCTIVE METALS

This is a continuation of application Ser. No. 560,972, filed Mar. 21, 1975, now abandoned, which is a continuation of application Ser. No. 449,823 now abandoned, filed Mar. 11, 1974.

BACKGROUND OF THE INVENTION

Waste materials, especially municipal wastes containing a complex variety of components including magnetic metal; non-magnetic, conductive metals; non-magnetic, non-conductive metals*; organic materials, such as plastics, vegetable matter, animal matter and the like; and non-metallic inorganic materials, such as glass, ceramic materials, earth, rock and the like. Various methods have been developed for separating these components into their component parts. For example, elutriation methods have been utilized to separate organic materials from the inorganic materials. Air tables have been employed to recover heavy metals. Air classifiers have been employed to separate the low density materials from the high density materials. Magnetic fields have been utilized to separate the magentic metals from non-magnetic materials. Each of these methods has its merits, but to the applicants' knowledge, there is no method besides the present process that accomplishes the separation of non-magnetic, conductive metals from a mixture, containing non-magnetic, conductive metals; non-magnetic, non-conductive metals; organic materials and non-metallic inorganic materials.

*For purposes of this invention, non-magnetic, non-conductive metals are nonferrous magnetic metals that are relatively poor electrical conductors as compared for example, to aluminum, copper, silver and the like. Typical non-magnetic, non-conductive metals include lead, austenitic stainless steel, titanium and nickel.

The objective of the present invention is to separate from a particulate mixture of materials the non-magnetic conductive metals (NC metals herein) in a size range of approximately 4 mesh to 12" or larger. The device described for that separation employes a linear motor which causes the separation of NC metals from non-magnetic, non-conductive materials.

The linear motor, when operating, generates a travelling magnetic field down the motor's length. When a particulate mixture is passed over the motor, eddy currents are induced in the non-magnetic conductive metals. The eddy currents generate a magnetic field in the metal that interacts with the moving field generated by the motor, and draws the NC metals along the linear motor force field. When the motor is arranged, and draws the NC metals away from the body of the mixture, a separation is achieved.

The use of eddy currents for separating aluminum (especially) from other metals or nonmetals is not new. In 1965 Eriez Magnetics developed an eddy current separator using permanent magnets mounted on a wheel underneath a table to induce the field and metal movement (See Nov. 1, 1965 issue of CSEN, pg. 125). Vanderbilt University developed a process using a single stationary magnet and conveys a particulate mixture through the magnetic field. The aluminum and some other nonferrous are deflected from entering the field. Vanderbilt has also built a travelling wave separator designed to exert forces on metals by sweeping a "pulse" past the sample. The pulse is generated by a linear array of electromagnets, each being briefly turned on in succession so as to move the pulse from one end to the other. (See the 1971 Annual Report on Magnetic Separation of Non-Ferrous Metal, Vanderbilt University, Department of Physics and Astronomy).

The use of a linear motor to generate a moving magnetic field for the required separation is unique and offers many advantages — high strength, low cost, low power costs, simple construction, and a flexibility for separator design not available with other systems.

SUMMARY OF THE INVENTION

The present invention is directed to the separation of nonmagnetic, conductive metals from mixtures containing such metals; non-magnetic, non-conductive metals; organic materials and nonmetallic inorganic materials. Separation is accomplished by passing the mixture of materials through a linear motor force field wherein the force field displaces the non-magnetic, conductive metals from the stream. For example, a stream of the mixture can be moved in one direction through a force field having a field direction traversing the first direction whereby the non-magnetic, conductive metals are laterally displaced from the stream. Alternatively separation is accomplished by passing a stream of the mixture through a first zone wherein the flow of material is changed from a first direction to a substantially different second direction. In the first zone the mixture is subject to a linear motor force field having a field direction is co-directional with said first direction whereby the velocity of the non-magnetic, conductive metals is accelerated in the first direction causing separation of those metals from the stream as it changes to the second direction in the first zone.

Preferably, the mixture of materials is passed through the force field as a thin stream. This can be accomplished by spreading the mixture out as a thin stream or layer on a conveyor belt or air table. The stream can also be transported on the periphery of a rotating drum or by gravitational means, such as an inclined chute or vertical duct. In order to maximize separation, the main streams can be passed through two or more linear motor force fields and the separated metals can be passed through two or more linear motor force fields as described herein.

For example, a mixture of materials can be spread out as a thin stream or layer on a first conveyor belt and passed through one or more linear motor force fields. The direction of the force field is perpendicular to the direction of the conveyor belt. A smaller vertical force component also exists which reduces friction on the moving metals. In the force field, the non-magnetic, conductive metals are deflected in the direction of the force field laterally from the stream. A second conveyor belt can be situated parallel to the first conveyor belt to transport the deflective non-magnetic, conductive metals after their separation from the stream of the first belt. The second conveyor belt transports the separated metals through one or more linear motor force fields having field directions perpendicular to the direction of the moving belt. The second separation will assist in separating the non-magnetic, conductive metals from those other materials that might have been mechanically displaced onto the second belt with the NC metals in the first separation.

The stream of materials can be allowed to fall vertically downward either free flight or on an incline plane, preferably within a duct, across a linear motor force field having a field direction traversing the direction of flow of the stream. The force field laterally displaces and separates the NC metals from the stream.

The mixture of materials can also be deposited as a thin stream on a perimeter of a large drum and allowed to pass through a linear motor force field situated above the gravitational drop off point of the drum wherein the direction of the field is tangent to the periphery of the drum. The force field accelerates the NC metals in a first direction, that is the tangential direction to the periphery of the drum, off the drum above the drop off point. The remainder of the stream falls vertically off the periphery of the drum at the drop off point.

Moreover the mixture can be passed through a linear motor force field at one terminus of a conveyor belt wherein the direction of the field is co-directional with the conveyor belt. The NC metals are accelereated off the belt in the force field in a direction co-axial and co-directional with the belt at the terminus of the conveyor whereas the remainder leaves or drops off the belt at the terminus in a direction substantially different from that of the NC metals.

DETAILED DESCRIPTION OF THE INVENTION

Figure 1:
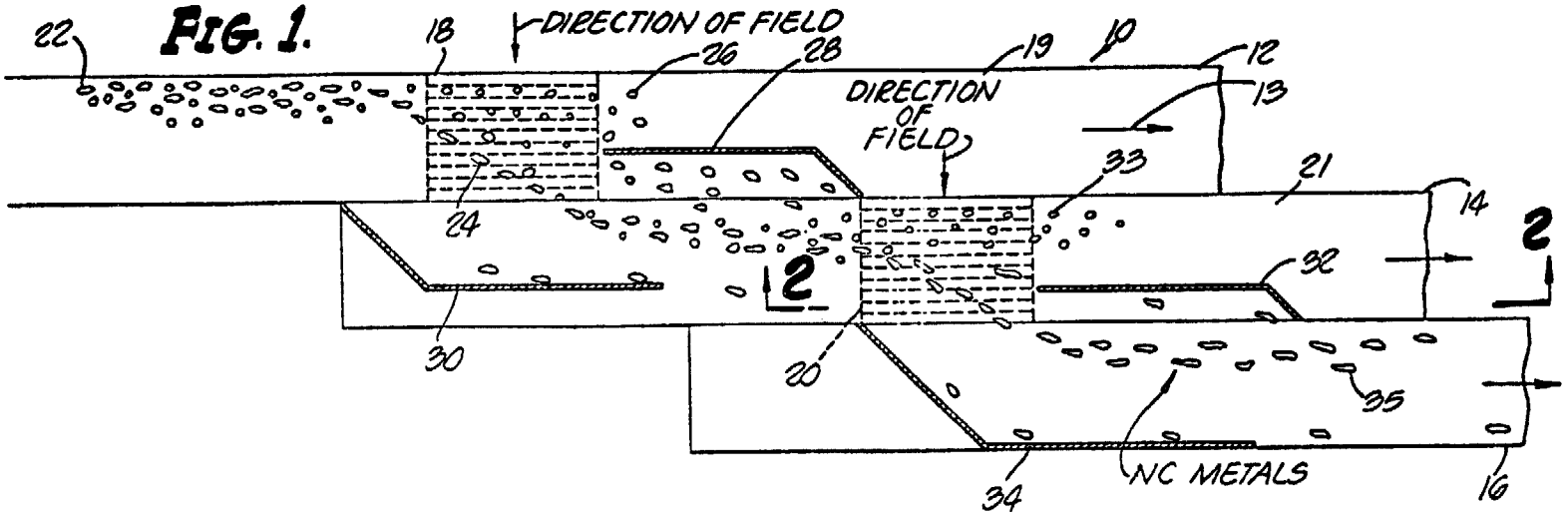
FIG. 1 is a top view of one embodiment of the separator apparatus of the present invention.

Referring to FIG. 1, a separator apparatus of the present invention 10 consists of three conveyor belts, a first belt 12, a second belt 14, and a third belt 16. The three conveyor belts are conventional endless conveyor belts supported on rollers 17 (see FIG. 2) having a master drive roller at one end (not shown) and a tension roller at the other end (not shown). One or more of the rollers 17 can be attached to a vibrating device (not shown) to vibrate one or more of the belts. The conveyor belts are preferably manufactured from materials free of magnetic metals and conducting metals including NC metals. The belt can be made from heavy fabrics, such as canvas; a synthetic fabric, such as woven nylon; natural and synthetic rubbers, optionally reinforced with fabric cord, glass cord, non-magnetic, non-conductive metal wire; glass fabrics, or metal sheet or of non-magnetic, non-conducting metal such as austenitic stainless steel. The conveyor belt can contain magnetic materials, such as iron wire. However, the magnetic materials will be attracted by the linear motor force field. An a.c. linear motor will vibrate a conveyor belt containing magnetic materials. Under the upper fold 19 of the belt 12 there is located a first linear motor 18. The direction of the field of the linear motor 18 is perpendicular to the direction of the three conveyor belts. In a like fashion, a second linear motor 20 is located under the upper fold 21 of the second belt 14. The force field direction of the second motor 20 is parallel and co-directional with the first motor 18. A guide 28 is situated slightly above the surface of the first belt 12 ahead of the first linear motor 18. The front wall of the guide 28 is tapered to guide material between the outer edge of the belt 12 and the wall of the guide 28 onto the second belt 14. The guide 28 is situated so that the material is forced onto the second belt in back of the second linear motor 20. A second guide 30 is situated above the top surface of the second belt 14. The guide 30 is placed opposite the first linear motor 18 and prevents NC metals from being displaced off the second belt when they are accelerated off the first belt 12 to the second belt.

A third guide 32 is situated slightly above the surface of the second belt 14 ahead of the second linear motor 20. The front wall of the third guide 32 slants toward the third belt 16. Opposite the second linear motor 20 and slightly above the surface of the third belt 16 is a fourth guide 34.

Figure 2:
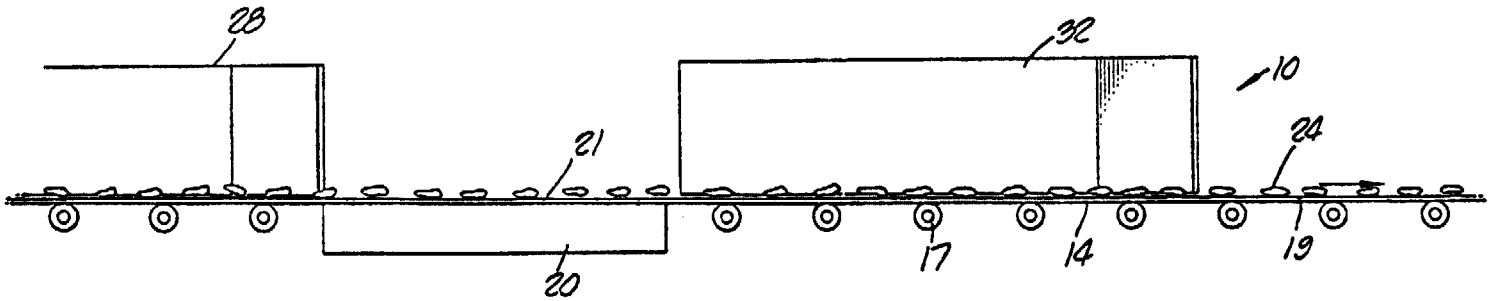
FIG. 2 is a cross-sectional view taken along lines 2—2 of FIG. 1.

A cross-sectional view of the apparatus 10 is illustrated in FIG. 2. In this figure, the relationship between the second guide 28, the third guide 32, the second linear motor 18, and the second belt 14 is clearly shown. The linear motor is situated as close to the upper fold 21 of the belt 14 as possible. Alternatively, the linear motor can be situated above the belt or one motor can be located above the belt and another motor can be located below the belt. Rather than having one linear motor, a series or plurality of linear motors can be installed along one belt to insure good separation of the non-magnetic, conductive metals from the mixture.

A feed mixture 22 of NC metals, non-magnetic, non-conductive metals, organic materials and/or non-metallic inorganic materials 22 is fed onto one side of the first belt 12 as a thin layer. The feed mixture 22 is free of magnetic metals. The feeder for the material 22 (not shown) can be a conventional feeder device such as a small conveyor chute or the like. The belt direction is shown by arrow 13. The mixture passes across the field of the first linear motor 18. In the region of the linear motor 18, the mixture 22 is separated into a first fraction 24 of non-magnetic, conductive metals and a second fraction 26 containing the other materials of the mixture. Non-magnetic, conductive metals are accelerated and displaced in the field of the linear motor in a direction parallel to the direction of the field. The non-magnetic non-conductive metals, organic materials and non-metallic inorganic materials are not affected by the force field of the linear motor. Normally the strength of the force field is sufficient to displace the non-magnetic, conductive metals completely off the first belt 12 onto the second belt 14. In fact, in some instances the field strength will be sufficient to force the non-magnetic conductive metals a great distance and the second guide 30 is required to prevent such metals from being thrown completely off second belt 14. In some instances, because of the shape or density of the metal, the non-magnetic conductive metals will not be completely displaced by the force field and will remain near the edge of the first belt 12. Such incompletely displaced NC metals are guided onto the second belt by the first guide 28. The remainder of the feed mixture 26 after passage through field of the first motor 18 proceeds along the first belt to disposal area where the material 26 can be either further treated or dumped as waste. Frequently, when the non-magnetic, conductive metals are displaced in the force field, some of the other material from the feed 22 is entrained in the moving particles 24 of NC metal and is displaced onto the second belt 14. All the material from the first belt 12 displaced onto the second belt 14 passes through the force field of the second linear motor 20 wherein the NC metals are displaced laterally from the belt onto the third belt 16. The field direction of the second linear motor 20 is perpendicular to the direction of the second belt 14 and parallel to and co-directional to the field of the first motor 18. The third guide 32 captures those non-magnetic, conductive metals that are not sufficiently displaced by the second linear motor 20 to be forced onto the third belt 16. The sloping forward wall of the third guide 32 guides these NC metals onto the third belt. The fourth guide 34 prevents NC metals from being displaced beyond the third belt 16 after the displacement from the second belt 14. The NC metals 35 on the third belt 16 are sent to a recovery area where these metals can be further treated as desired.

In some situations, more than three belts or more than two linear motors may be necessary to effectively separate the nonmagnetic, conductive metals from the mixture. The non-NC metals 33 from the second belt 14 are treated in the same manner as the second fraction 26, that is the remainder of the feed mixture 22 as described above. The belt and/or feed mixture can be vibrated in the zones of the linear motors to enhance separation of the NC metals from the other materials; however, since the linear motor exerts a small vertical force upwardly on the NC metals, vibration is normally not required to obtain separation of the NC metals from the other materials.

Linear motors are linear-motion electrical machines. Linear motors resemble a conventional rotary electrical inductive motor stator which has been cut by a radial plane and subsequently unrolled into a flat plate-type configuration. Linear motors are discussed at length by E. R. Laithwaite, Linear-Motion Electrical Machines, Proceedings of the IEEE, Vol. 58, No. 4, pgs. 531–542, April 1970. The linear motor can be a single phase motor if operated in any of the available configurations that are used on single phase induction motors or a 2-phase, 3-phase or other poly-phase motor.

Non-magnetic, conductive metals, that is, NC metals, are nonferromagnetic metals that are electrically conductive. Typical non-magnetic, conductive metals include aluminum, copper, silver, gold, tin, zinc, platinum, palladium, beryllium, antimony, cadmium, chromium, gallium, iridium, lead, magnesium, manganese, mercury, molybdenium, tungsten, vanadium, zirconium, and non-magnetic, conductive alloys thereof.

Non-magnetic, non-conductive metals are non-ferromagnetic metals that are relatively poor electrical conductors. Typical non-magnetic, non-conductive metals include lead, austenitic stainless steels, titanium and nickel.

Figure 3:
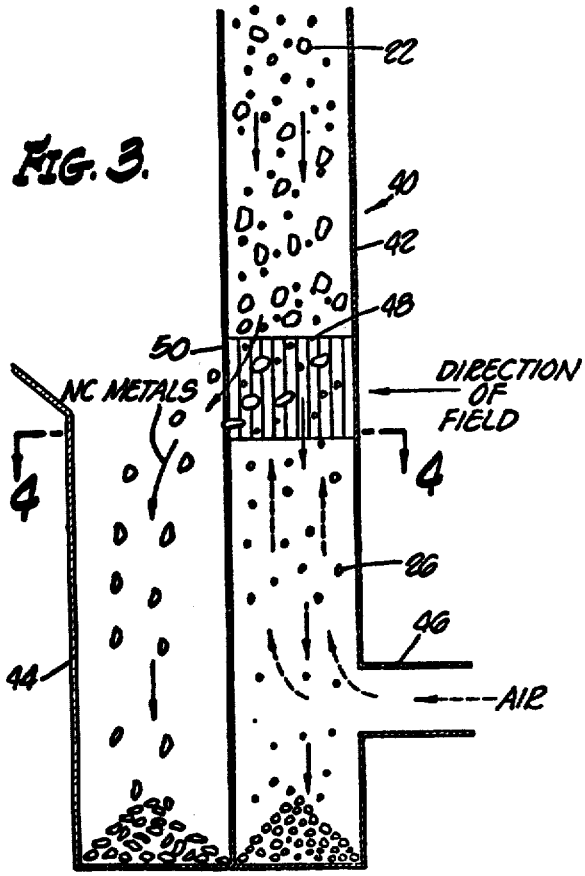
FIG. 3 is a side cross-sectional view of another embodiment of the separator apparatus of the present invention.
Figure 4:
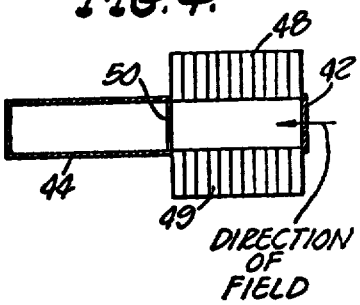
FIG. 4 is a top cross-sectional view of the separator apparatus taken along lines 4—4 of FIG. 3.

Another embodiment of the apparatus of the present invention is illustrated in FIG. 3. The separator apparatus 40 includes an enclosed chute 42, a collection hopper 44, an air intake 46 and linear motors 48 and 49 (See FIG. 4). A feed mixture 22 is allowed to free fall down chute 42 through the force field of the linear motors 48 and 49. The non-magnetic, conductive metals 24 of the mixture 22 are displaced laterally co-directionally with the field direction of the linear motor into hopper 44 through aperature 50 of the chute 42. The remaining portion of the feed mixture 22 passing through the force field of the linear motors 48 and 49 falls to the bottom of chute 42. Air is blown into chute 42 upwardly therethrough from intake 46 to separate the particles of mixture 22 and permit the free flow of the NC metals 24 from the mixture 22 in the force field zone of the linear motors. A cross-sectional view of the apparatus 40 is shown in FIG. 4. The two linear motors 48 and 49 are positioned on opposing sides of the chute 42 adjacent to aperture 50. In the region of the linear motors, the inner side of the linear motors form the walls of the chute 42.

Figure 5:
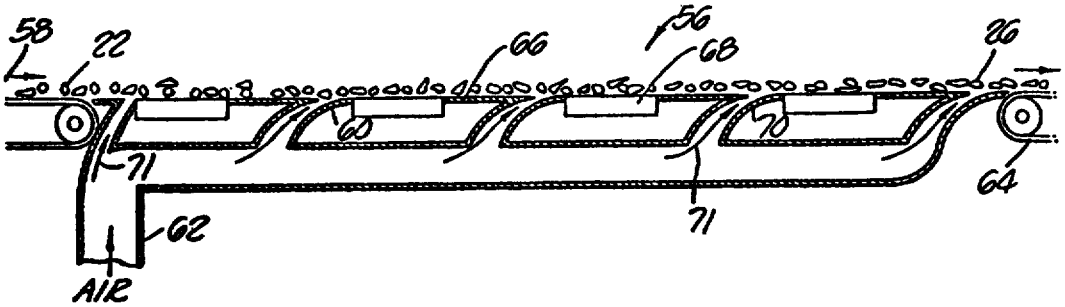
FIG. 5 is a side cross-sectional view of another embodiment of the separator apparatus of the present invention.
Figure 6:
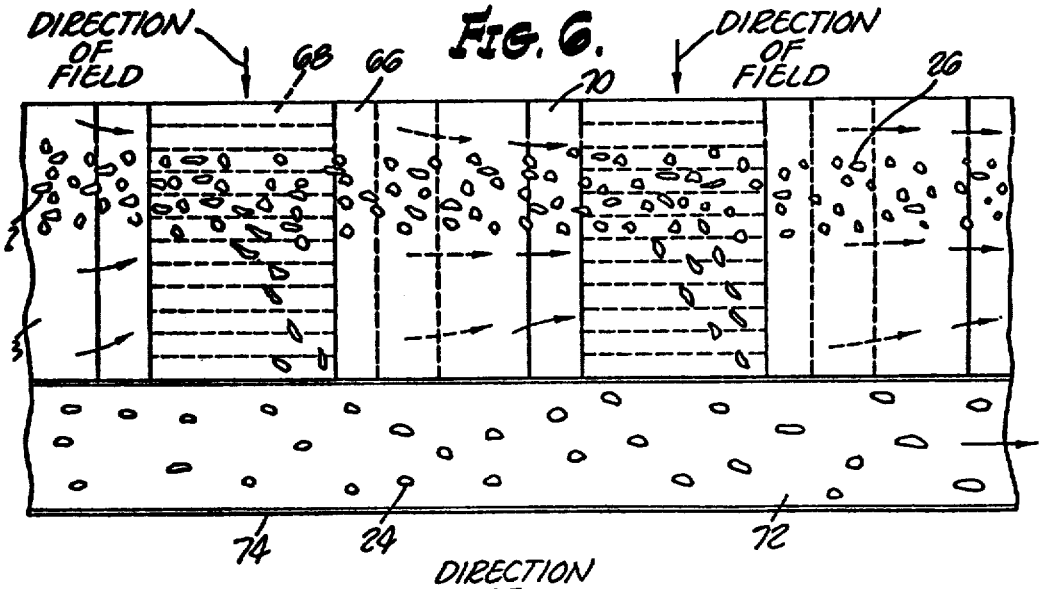
FIG. 6 is an enlarged top view of a portion of the separator apparatus illustrated in FIG. 5.

Another embodiment of the present invention is illustrated in FIGS. 5 and 6. The separator apparatus 56 is illustrated in FIG. 5 includes a feeder conveyor belt 58, an air conveyor 60, an air intake conduit 62 and a second conveyor belt 64. The air conveyor 60 consists of a table surface 66, a plurality of linear motors 68 whose top surface forms part of the air table's 60 top surface and a plurality of air ducts 70.

In the operation of the apparatus 56, the mixture 22 is conveyed by belt 58 to the table 60. A stream of air 71 from the conduits 70 partially lifts and moves the material 22 along the length of the table towards the second conveyor 64. Between each of the ducts is located a linear motor 68. The field direction of each linear motor is perpendicular to the direction of the air stream, the stream of the mixture 22 and the table 60. As the stream of the mixture 22 flows over the linear motors 68, wherein the non-magnetic, conductive metals are laterally displaced from the stream and conveyed to a third conveyor belt 72 (see FIG. 6). A guide 74 is mounted on the far side of the conveyor to capture NC metals on the belt. At the end of the air table 60, the remaining portion of the feed mixture, that is the second fraction 26, is fed onto a second conveyor 64 and passed to further treatment stages as desired.

Figure 7:
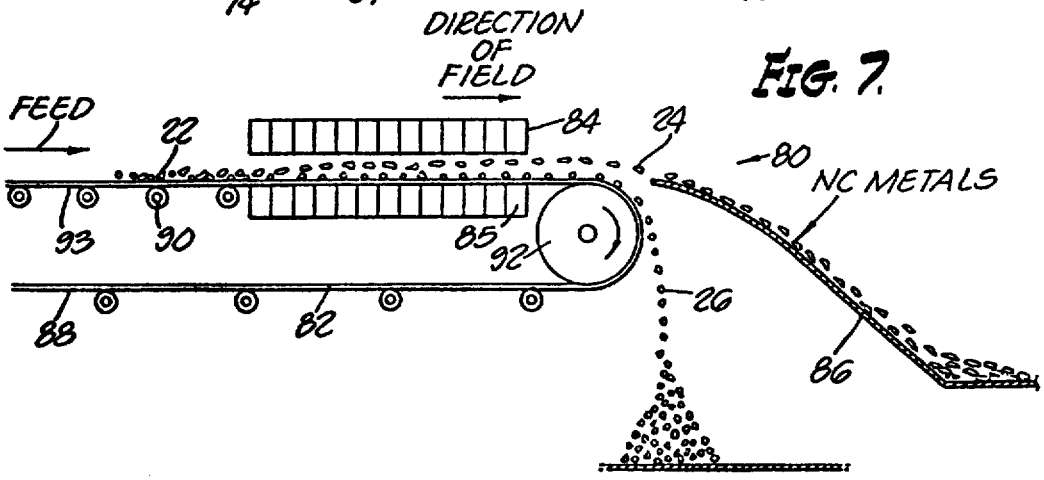
FIG. 7 is a side view of a further embodiment of the separator apparatus of the present invention.

Referring to FIG. 7, another embodiment of the separator apparatus of the present invention is separator 80 which consists of a conveyor belt 82 and a pair of linear motors 84 and 85, and a separator guide 86. The conveyor belt 82 is supported by a plurality of rollers 90, a tension roller 92, and a drive roller (not shown) at the other end of the belt. The two linear motors 84 and 85 are situated above and below the top fold 93 of the belt 82 respectively. The mixture 22 rides on the belt through the force field of the linear motors 84 and 85. The field direction of the linear motors is parallel and co-directional with the flow of the material. The field of the linear motor has no effect on the non-magnetic, non-conductive metals, organic materials and non-metallic inorganic portions of the mixture and those materials, a second fraction 26, remain on the belt until they drop off the end of the belt at the roller 92. the nonmagnetic, conductive metals, the first fraction 24, are accelerated by the field of the linear motors and are accelerated forward and thrown off the end of the belt for some distance. The trajectory of the NC metal fraction 24 is sufficient to throw the metals over the tip of the guide 86 to have the metals fall out the back slope of the guide 86. The second fraction 26 falls behind the guide underneath the end of the belt 82.

Figure 8:
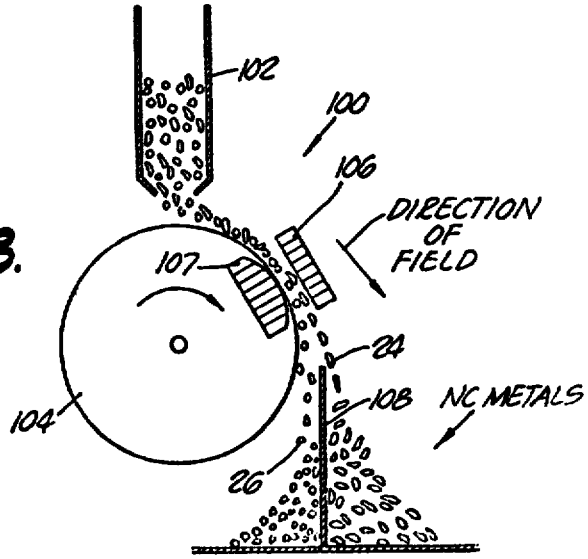
FIG. 8 is a side view of another embodiment of the separator apparatus of the present invention.

Still another embodimennt of the present invention is illustrated in FIG. 8. The separator apparatus 100 of FIG. 8 includes a feed hopper 102, a drum 104, two linear motors 106 and 107, and a guide 108. The mixture 22 is fed from the hopper 102 onto the top periphery of the drum 104. The drum rotates in a clockwise direction and moves the mixture through the force field of linear motors 107 and 106. The direction of the field of the motors 106 and 107 is tangential and codirectional to the drum. The force field of the linear motors accelerates the NC metals and projects them tangentially off the drum. The NC metals 24 are projected to the right side of the guide 108 while the second fraction 26 remains on the surface of the drum 104 until it falls from the surface of the drum under the influence of gravity to land on the left side of the guide 108.

Figure 9:
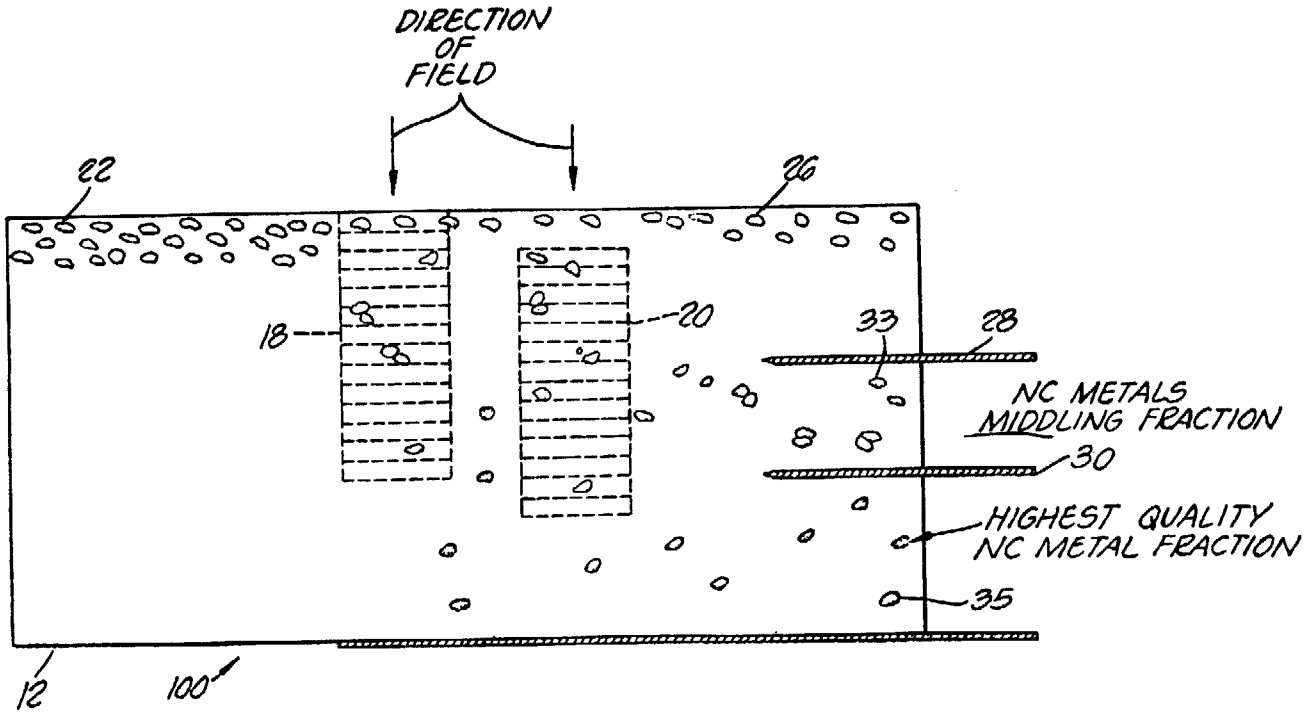
FIG. 9 is a top view of one of the preferred embodiments of the present invention.

In FIG. 9 one of the preferred apparatus 100 of the present invention is illustrated. The apparatus 100 comprises a conveyor belt 12; first and second linear motors 18 and 20; first and second guides 28 and 30; and wall 74. The stream of materials 22 is fed on the right side of the belt 12. The stream 22 passes through the force field of the first motor 18 wherein NC metals are displaced to the left side. The separated materials passes through the force field of the second motor 20 where additional separation of the NC metals from the other materials of the stream 22 is accomplished. The wall 74 prevents NC metals from being propelled off the belt 12. The guides 28 and 30 are adjustable widthwise across the belt 12. The guides can be placed to insure a substantially pure NC metal fraction, a fraction of materials substantially free of NC metals, and a middling fraction which can be recycled to the feed stream 22 for separation or passed to another separation apparatus, such as the apparatus 100.

In the preferred embodiment of the invention, the mixture 22 is moved as close as possible to the linear motors so that the NC metals can interact with the strongest possible magnetic field.

EXAMPLE I

Two Kirsch brand a.c. electric linear motors (2-phase motors) were used to separate aluminum from a sample of sized and air classified trash obtained from Sira Corp. of Palo Alto. The trash was hand fed onto a vibrating conveyor belt and transported over the motors. About 73% of the aluminum was separated. The size range of the sample treated was from 1" to ¼".

EXAMPLE II

A three phase experimental linear motor operated at 220 volts, 3.1 amps and 60 cycles was used for testing. The three phase motor provided greater thrusts, consumed less power and allowed larger operating times than the Kirsch motors. Another laboratory separator was built and separations were made using the new motor. The material tested was the metal fraction of an electrostatic concentrate derived from sized and air classified Sira Corp. trash. The test procedure consisted of hand feeding individual particles of metal onto a flat vibrating conveyor and collecting separately the deflected and non-deflected pieces. FIG. 1 shows the separator and Tables 1 and 2 show the results of the tests.

Table 1

SEPARATION OF METALS FROM TRASH WITH A THREE PHASE, 200V., 3.1 Amp, 60 Cycle LIM

| Component | Deflected Weight Grams | Non-Deflected Weight Grams | Recovery % |
|---|---|---|---|
| Aluminum | 180.6 | 37.4 | 83 |
| Brass | 3.2 | 18.9 | 15 |
| *Copper | 0.0 | 11.3 | 0 |

Table 1-continued

SEPARATION OF METALS FROM TRASH WITH A THREE PHASE, 200V., 3.1 Amp, 60 Cycle LIM

| Component | Deflected Weight Grams | Non-Deflected Weight Grams | Recovery % |
|---|---|---|---|
| Zinc & Pot Metal | 14.8 | 4.1 | 78 |

*All the copper in this sample occurred as partially insulated fine wire. NC metal wire, such as copper wire, are not affected by the linear motor force field to the same degree as solid or ring shaped pieces of NC metals. Massive copper such as pennies have been deflected.

TABLE 2

A SCREEN ANALYSIS FOR THE ALUMINUM FRACTION

| Deflected Aluminum | | | Non-Deflected Aluminum | | |
|---|---|---|---|---|---|
| Size | Weight Grams | Weight % | Size | Weight Grams | Weight % |
| 1"×½ | 69.6 | 38.3 | 1"×½ | 1.7 | 4.5 |
| ½×⅜ | 78.2 | 43.3 | ½×⅜ | 13.3 | 35.8 |
| ⅜×¼ | 30.2 | 16.6 | ⅜×¼ | 17.8 | 47.8 |
| ¼×Pan | 2.6 | 1.8 | ¼×Pan | 4.6 | 12.1 |
| Total | 180.6 | 100.0 | Total | 37.4 | 100.0 |

Table 1 shows that the process is applicable to the separation of metals in general and not only aluminum.

Table 2 shows that the degree of separation is dependent on particle size. Virtually all of the pieces of aluminum larger than ½ inch were deflected while less than 40% of those smaller than ¼" were deflected. Observation indicated that larger pieces give better response to separation. Pieces as large as 12 inches were tested and observed to be deflected.

EXAMPLE III

In an attempt to increase thrust at a distance, a motor-generator set was used to study the effect of changing frequency and current on thrust on the motor used in Example II. Tables 3 and 4 summarize some of the significant results obtained. Table 3 shows that increasing frequency causes a proportionate increase in thrust at a given amperage. The extra thrust is generated without generating any increase in heat in the motors windings. Increasing the frequency has the disadvantage that the inductive reactance of the motor increases which in turn increases the size of the power supply required to power the motor. This problem can be over come by employing a resonant circuit to cancel the inductive reactance and lower the power supply size. A reduction in operating voltage can be obtained by connecting each coil of the motor in parallel rather than in series. Table 4 shows that increasing the current increases the thrust. However, heat is generated which is related to the square of the current. These two factors have to be balanced in an optimum design. Inductive or capacitive "resistance" does not generate heat.

Some of the anticipated operating ranges of certain variables are as follows:

1. Frequency: 30–2,000 cycles per second, prefer 400 to 800 cycles per second range
2. Current: 0.5–50 amps per coil

TABLE 3

EFFECT OF FREQUENCY ON THRUST AT VARIOUS DISTANCES FROM LIM FACE

| Frequency Cycle/Sec. | Current Amps | Voltage | THRUST, GRAMS Distance from LIM face 0.10" | 0.20" | 0.30" | 0.50" |
|---|---|---|---|---|---|---|
| 30 | 2.0 | 85 | 1.2 | 0.8 | 0.3 | 0.1 |
| 60 | 2.0 | 153 | 2.8 | 1.7 | 1.0 | 0.3 |
| 120 | 2.0 | 295 | 4.5 | 2.7 | 1.1 | 0.7 |

TABLE 3-continued

EFFECT OF FREQUENCY ON THRUST AT VARIOUS DISTANCES FROM LIM FACE

| Frequency Cycle/Sec. | Current Amps | Voltage | THRUST, GRAMS Distance from LIM face 0.10" | 0.20" | 0.30" | 0.50" |
|---|---|---|---|---|---|---|
| 400 | 1.9 | 510 | 13.4 | 8.6 | 4.9 | 1.8 |

TABLE 4

EFFECT OF CURRENT ON THRUST AT 60 $H_z$ AT VARIOUS DISTANCES FROM LIM FACE

| Frequency Cycle/Sec. | Current Amps | Voltage | THRUST, GRAMS Distance from LIM face 0.10" | 0.20" | 0.30" | 0.50" |
|---|---|---|---|---|---|---|
| 60 | 1.0 | 79 | 0.6 | 0.3 | 0.2 | 0 |
| " | 2.0 | 153 | 2.8 | 1.7 | 1.0 | 0.3 |
| " | 4.0 | 263 | 8.0 | 4.7 | 2.7 | 1.0 |
| " | 6.0 | 330 | 12.0 | 7.3 | 4.7 | 1.6 |
| " | 7.0 | 352 | 12.1 | 7.1 | 4.4 | 1.9 |
| " | 8.0 | 372 | 15.3 | 8.9 | 5.5 | 2.0 |
| " | 9.0 | 394 | 18.2 | 10.8 | 6.3 | 2.2 |

*For a 2.68 Gram rectangular aluminum plate 3/32" thick.
LIM is an abbreviation for Linear Induction Motor.

EXAMPLE IV

A pilot plant was constructed to treat larger quantities of trash. A sample of Palo Alto air classified, magnetically separated trash was scalped at 4" and then screened at ¾". The 4 × ¾" fraction was fed onto a stainless steel conveyor belt and moved over one 3 phase, 24 coil, linear motor. In one test, three pounds and ten ounces of aluminum concentrate was recovered. Aluminum recovery was 61.6%. Grade was 83% can stock, 14% miscellaneous aluminum, such as castings and 3% non-ferrous non-aluminum metals. Approximately 22 pounds of trash was treated in ten minutes. Energy consumption was about 0.8 KWHr. The linear motor was operated at 490 cycles per second.

TABLE 5

Separation Results for Example IV

| | wt. oz. | wt. % | All Al. oz. | Aluminum Can Stock oz. | Non Mag. Non Al. oz. | All Al. | Assay % Can Stock | Assay % Non Mag. Non Al. | Distribution, % All Al. | Distribution, % Can Stock | Distribution, % Non Mag. Non Al. |
|---|---|---|---|---|---|---|---|---|---|---|---|
| Feed | 348 | 100 | 91 | — | 16 | 26.1 | — | 4.6 | 100 | 100 | 100 |
| Conc. | 58 | 16.6 | 56 | 48 | 2 | 96.5 | 82.8 | 3.4 | 61.6 | — | 12.5 |
| Tails | 290 | 83.4 | 35 | — | 14 | 12.0 | — | 4.8 | 38.4 | — | 87.5 |

— Indicates no determination made.

We claim:

1. A method of separating relatively large non-magnetic conductive components from a mixture of non-magnetic conductive metal components and non-magnetic non-conductive material, including the steps of:

generating a traveling electromagnetic wave from a linear motor stator with a frequency from about 400 to about 800 cycles per second;

passing a stream of a mixture of non-magnetic conductive metal components of a size at least about ¼ inch and non-magnetic non-conductive material through said traveling wave along the face of the linear motor stator on a moving belt spacing the mixture from said stator, with the direction of the linear motor traveling wave generally perpendicular to the direction of the stream of mixture, inducing eddy currents in the conductive metal components of the mixture producing forces acting on the conductive metal components in the direction of the traveling wave and moving conductive metal components from the stream along paths parallel to the stator face at a velocity substantially less than the velocity of the traveling wave; and collecting the components which are moved by the forces acting in the direction of the traveling wave.

2. The method according to claim 11 wherein the traveling wave is created by a first linear motor stator, and a second traveling wave is created by a second linear motor stator, and including the steps of passing a second stream of the collected components through said second traveling wave along the face of the second linear motor stator on a moving belt spacing the mixture from the stator, with the direction of the second traveling wave generally perpendicular to the direction of the second stream, and collecting the components which are moved by the forces acting in the direction of the second traveling wave.

3. The method according to claim 1 wherein the linear motor stator is three phase.

4. The method of claim 1 including generating the traveling wave with a pair of spaced linear motor stators and passing the stream of the mixture between the stators.

5. The method of claim 1 including generating the traveling wave with the linear motor stator on one side only of the stream.

6. In a system for separating non-magnetic conductive metal components of a size at least about ¼ inch from a mixture of non-magnetic conductive metal components and non-magnetic non-conductive material, the combination of:

a linear induction motor stator having a winding on a core;

an electric power source of a frequency from about 400 to about 800 cycles per second connected to said winding providing a traveling wave along the axis of said stator;

a belt for moving a stream of the mixture across said stator and spacing the mixture from said stator, with the direction of the linear motor traveling wave generally perpendicular to the direction of the stream of mixture, inducing eddy currents in the conductive metal components of the mixture for producing forces acting on the conductive metal components in the direction of the traveling wave for displacing the conductive metal components from the stream along paths parallel to the stator face; and means for collecting said components which are moved from the stream along paths parallel to the stator face.

7. A system as defined in claim 6 including:

a second linear induction motor stator having a winding on a core; and means for mounting said stators in spaced opposing relation with the stream moving therebetween and with said source connected to each of said windings.

8. A system as defined in claim 6 having a stator on one side only of said stream.

* * * * *